US012799643B2

(12) United States Patent
Yao

(10) Patent No.: US 12,799,643 B2
(45) Date of Patent: Nov. 17, 2026

(54) LIGHT-REFLECTIVE YARN CAPABLE OF PREVENTING GLASS MICROBEADS FROM FALLING OFF

(71) Applicant: CHANCE LINE INDUSTRIAL CO., LTD., Siansi Township (TW)

(72) Inventor: Ming-Hsien Yao, Siansi Township (TW)

(73) Assignee: CHANCE LINE INDUSTRIAL CO., LTD., Siansi Township (TW)

( * ) Notice: Subject to any disclaimer, the term of this patent is extended or adjusted under 35 U.S.C. 154(b) by 0 days.

(21) Appl. No.: 19/037,104

(22) Filed: Jan. 25, 2025

(65) Prior Publication Data

US 2025/0250723 A1 Aug. 7, 2025

(30) Foreign Application Priority Data

Feb. 7, 2024 (TW) ..... 113105089

(51) Int. Cl.

| | |
|---|---|
| ***D02G 3/44*** | (2006.01) |
| ***D02G 3/34*** | (2006.01) |
| ***D02G 3/40*** | (2006.01) |
| *D02G 3/18* | (2006.01) |

(52) U.S. Cl.

CPC ..... *D02G 3/44* (2013.01); *D02G 3/346* (2013.01); *D02G 3/404* (2013.01); *D02G 3/18* (2013.01); *D02G 3/185* (2013.01); *D10B 2401/20* (2013.01)

(58) Field of Classification Search

CPC ..... D02G 3/44; D02G 3/346; D02G 3/404; D02G 3/18; D02G 3/185; D10B 2401/20

USPC ..... 57/207

See application file for complete search history.

(56) References Cited

U.S. PATENT DOCUMENTS

| | | | | |
|---|---|---|---|---|
| 4,383,403 | A * | 5/1983 | Nakayama | D02G 3/346 428/377 |
| 4,849,265 | A | 7/1989 | Ueda et al. | |
| 7,131,158 | B2 * | 11/2006 | Brown | D04B 21/04 8/151.2 |
| 7,665,288 | B2 * | 2/2010 | Karayianni | D02G 3/328 57/210 |
| 8,893,603 | B2 * | 11/2014 | Weber | D07B 1/16 87/8 |
| 10,388,430 | B1 * | 8/2019 | Evans | G02B 6/4413 |
| 10,649,269 | B2 * | 5/2020 | Lee | G02F 1/134309 |
| 11,576,444 | B2 * | 2/2023 | Agarwal | D06M 15/564 |

(Continued)

FOREIGN PATENT DOCUMENTS

| | | |
|---|---|---|
| CN | 113249807 A | 8/2021 |
| JP | S62021887 A | 1/1987 |

(Continued)

*Primary Examiner* — Alissa J Tompkins
*Assistant Examiner* — Dakota Marin
(74) *Attorney, Agent, or Firm* — Daniel Polk; Darryl Scott

(57) ABSTRACT

A light-reflective yarn being a layered material formed by stacking a base layer, a plurality of glass microbeads and at least one adhesive layer; the glass microbeads are disposed on at least one surface of the light-reflective yarn; a wrapping layer being a resin material and having transmittancy, and the wrapping layer wraps the light-reflective yarn and covers the glass microbeads. The glass microbeads of the light-reflective yarn are protected by the wrapping layer and will not fall off from the light-reflective yarn.

24 Claims, 9 Drawing Sheets

(56) References Cited

U.S. PATENT DOCUMENTS

| | | | | |
|---|---|---|---|---|
| 11,780,772 | B2 * | 10/2023 | Fedurco | C03C 25/323 428/392 |
| 12,127,615 | B2 * | 10/2024 | Yao | G09F 3/02 |
| 12,276,047 | B2 * | 4/2025 | Liao | D02G 3/346 |
| 12,286,738 | B2 * | 4/2025 | Yao | D05B 93/00 |
| 2002/0066543 | A1 * | 6/2002 | Lilly | G07D 7/1205 162/162 |
| 2003/0089251 | A1 * | 5/2003 | Brown | B41M 1/12 101/129 |
| 2003/0215631 | A1 * | 11/2003 | Kang | D02G 3/346 428/292.1 |
| 2006/0098286 | A1 * | 5/2006 | Sagar | C03C 12/02 359/530 |
| 2009/0035520 | A1 * | 2/2009 | Sagar | B41F 15/10 427/199 |
| 2010/0210745 | A1 * | 8/2010 | McDaniel | C09D 7/48 521/55 |
| 2017/0335509 | A1 * | 11/2017 | Kim | D02G 3/36 |
| 2018/0009264 | A1 * | 1/2018 | Delfino | B60C 9/0028 |
| 2018/0127915 | A1 * | 5/2018 | Nowak | D06P 1/0012 |
| 2020/0123682 | A1 * | 4/2020 | Nukui | C03C 27/10 |
| 2021/0245473 | A1 * | 8/2021 | Yao | C09K 11/77062 |
| 2022/0161528 | A1 * | 5/2022 | Yao | D01D 5/426 |

FOREIGN PATENT DOCUMENTS

| | | | |
|---|---|---|---|
| JP | H01221539 | A | 9/1989 |
| JP | H08337951 | A | 12/1996 |
| JP | 2019523896 | A | 8/2019 |
| KR | 1020180014369 | A | 2/2018 |
| TW | 201741510 | A | 12/2017 |

* cited by examiner

LIGHT-REFLECTIVE YARN CAPABLE OF PREVENTING GLASS MICROBEADS FROM FALLING OFF

FIELD OF THE INVENTION

The invention relates to a light-reflective yarn, more particularly to a light-reflective yarn capable of protecting glass microbeads of the yarn and preventing the glass microbeads from detaching or falling off.

DESCRIPTION OF THE RELATED ART

In the current techniques, a kind of light-reflective yarns are made by cutting light-reflective films. FIG. 1 shows a conventional light-reflective film 10 with glass microbeads 16. The light-reflective film 10 can be cut into a plurality of light-reflective yarns 20 as shown in FIG. 2.

A surface of a base layer 12 of the light-reflective film 10 is combined with the glass microbeads 16 through a bonding layer 14. A reflective layer 18 made of metal, such as aluminum or silver, is plated on bottom sides of the glass microbeads 16, and the reflective layer 18 is silver in color. After light is incident on the glass microbeads 16, the reflective layer 18 will reflect the light, causing the light to be retroreflected from an incident angle.

The light-reflective film 10 can be cut to form the light-reflective yarn 20 shown in FIG. 2. The glass microbeads 16 and the reflective layer 18 of the light-reflective yarn 20 enable the light-reflective yarn 20 to have a function of reflecting light. When the light-reflective yarn 20 is woven into a fabric, the woven fabric has a light-reflective function. The light-reflective yarn 20 made of the glass microbeads 16 and the silver or aluminum reflective layer 18 is capable of reflecting reflected light of high lumens.

However, the conventional light-reflective yarn 20 that uses the glass microbeads 16 to reflect light has problems in weaving. Because the glass microbeads 16 are exposed on the surface of the light-reflective yarn 20, during the weaving process, the glass microbeads 16 will fall off from the light-reflective yarn 20 and fall into the machine, which will not only affect the light-reflective efficiency of the light-reflective yarn 20, but also cause damage to the knitting machine, especially causing problems which are more serious in the circular knitting machine or the warp knitting computer jacquards, the glass microbeads 16 will fall into the cylinder of the crochet needle of the knitting machine, causing the machine to jam and damaging the knitting machine.

Furthermore, in addition to the problem of the glass microbeads 16 falling off in the conventional light-reflective yarn 20, the colored high-lumen light-reflective yarn 20 also has the problem of revealing silver in color (silver leakage). In the conventional method for producing colors for the light-reflective yarn 20, two color layers (not shown in the figures) are disposed on top and bottom surfaces of the light-reflective film 10 respectively. More specifically, the color layers are disposed on the glass microbeads 16, and therefore, the light-reflective yarn 20 made by cutting has a color.

However, as shown in FIG. 2, the color layers are only located where the glass microbeads 16 are, and there is no color layer on two side surfaces 22 of the light-reflective yarn 20. Since the two side surfaces 22 are formed after cutting, the light-reflective yarn 20 in FIG. 2, only its top and bottom surfaces have the produced color, and the reflective layer 18 is exposed on the side surface 22 of the light-reflective yarn 20. Since the glass microbeads 16 are transparent, when light is diffused, the entire side surface 22 of the light-reflective yarn 20 looks silver visually, which is the color of the reflective layer 18, resulting in the colors of different positions of the light-reflective yarn 20 inconsistent, and the colors presented by the two side surfaces 22 are different from the colors of the top and bottom surfaces.

In the conventional technology, in order to make the colored light-reflective yarns 20, a large amount of the colored light-reflective film 10 needs to be made, and then the colored light-reflective yarns 20 are cut out, it is not possible for a factory to make only a small amount of the colored light-reflective film 10 in one process.

SUMMARY OF THE INVENTION

The invention is to solve the drawbacks of conventional light-reflective yarns. An object of the invention is to provide a light-reflective yarn with glass microbeads, capable of protecting the glass microbeads of the light-reflective yarn and preventing the glass microbeads from falling off, so as to solve the difficulties encountered by the industry.

One object of the invention is to provide a light-reflective yarn capable of preventing glass microbeads from falling off, which can solve the problem of inconsistent colors on different surfaces of conventional light-reflective yarns, that is, solve the problem of revealing silver in color in conventional high-lumen light-reflective yarns.

One object of the invention is to provide a light-reflective yarn capable of preventing glass microbeads from falling off, a colored light-reflective yarn can be easily made, and a colored light-reflective yarn can be made with a small amount of light-reflective film.

A light-reflective yarn provided by the invention comprises:

- a base layer having two surfaces;
- a plurality of glass microbeads adhered to at least one of the surfaces of the base layer with at least one adhesive layer and forming at least one layer of glass microbeads;
- the light-reflective yarn is formed by the base layer, the glass microbeads and the adhesive layer, and has two surfaces and sides other than the two surfaces; the at least one layer of the glass microbeads is disposed on at least one of the surfaces of the light-reflective yarn; and
- a wrapping layer made of a resin material and having transmittancy, the wrapping layer wraps the entire light-reflective yarn.

The light-reflective yarn can further comprise: at least one reflective layer disposed on bottom sides of the glass microbeads to reflect light.

Thereby, the glass microbeads of the light-reflective yarn are covered by the wrapping layer, the wrapping layer protects the glass microbeads and prevents the glass microbeads from falling off, so that the light-reflective yarn can be woven, even if the light-reflective yarn is pulled by crochet needles of a circular knitting machine, the glass microbeads will not fall off or detach, capable of preventing damage to the knitting machine and maintaining a complete light-reflective function of the light-reflective yarn.

The wrapping layer covers the glass microbeads and wraps the sides of the light-reflective yarn.

Preferably, the wrapping layer is a resin containing acrylic acid and silane, or a resin containing thermoplastic polyurethane and silane, or a resin containing acrylic acid, silane and thermoplastic polyurethane.

Preferably, the wrapping layer is a resin containing silane, so that good bonding properties are provided between the wrapping layer and the glass microbeads.

Preferably, the wrapping layer is a colored resin, so that the light-reflective yarn has a color. The sides of the light-reflective yarn have a color of the wrapping layer. The light-reflective yarn of the invention is made by cutting a light-reflective film, and a color of the light-reflective yarn is formed by a color of the wrapping layer. Therefore, regardless of whether the light-reflective yarn is produced with a color, the light-reflective film does not need to be produced with a color, making production of the light-reflective film simpler, even if the colored light-reflective yarn is ordered in a small amount, it can still be produced in a small amount, regardless of a size of an order, capable of solving the industry's inability to produce the colored light-reflective film and light-reflective yarn in small amounts.

The resin of the wrapping layer is added with a transparent pigment, and the pigment is a transparent dye or colorant.

Preferably, the wrapping layer is made of a liquid resin after drying.

Preferably, the adhesive layer is a material containing acrylic acid or a material containing polyurethane, so that good bonding properties are provided between the wrapping layer and the adhesive layer.

Preferably, a gap is provided between the two adjacent glass microbeads; the wrapping layer forms a larger thickness at each of the gaps. Thereby, when the wrapping layer has a color, in the gaps, more ink, pigments or color materials of the wrapping layer are accumulated, making a color purity of the light-reflective yarn higher and a color of the yarn more obvious and brighter.

The light-reflective yarn of the invention cannot be protected with polyvinyl alcohol (PVA), because PVA will dissolve when exposed to water and become sticky in a humid environment. If liquid polyvinyl alcohol is smeared to outer surfaces of the light-reflective yarn of the invention, polyvinyl alcohol requires ripening time, and a viscosity of polyvinyl alcohol will cause the light-reflective yarn to stick together, resulting in an inability to produce yarn, so polyvinyl alcohol cannot be applied to the invention.

The reflective yarn of the invention can be constructed as a wrapped yarn, wherein at least one wrapping yarn is wrapped around the outer periphery of the reflective yarn, or at least two wrapping yarns are wrapped around the outer periphery of the reflective yarn in an S direction and a Z direction respectively to form a reflective composite yarn. The wrapping yarn is wrapped around the reflective yarn in a manner that more glass microbeads of the reflective yarn are exposed. Both the outer peripheries of the reflective yarn and the wrapping yarn in the reflective composite yarn are wrapped with a wrapping layer.

BRIEF DESCRIPTION OF DRAWINGS

The objects, features, and achieved efficacies of the invention can be understood from the description and drawings of the following preferred embodiments, in which.

DETAILED DESCRIPTION OF THE INVENTION

The invention relates to a light-reflective yarn (or light-reflective thread) with glass microbeads. The glass microbeads can be penetrated by light, and a technical means of the invention lies in preventing the glass microbeads of the light-reflective yarn from detaching or falling off from the light-reflective yarn, so that the light-reflective yarn of the invention can be woven into a fabric by a knitting machine, and a light-reflective function of the light-reflective yarn will not be impaired.

Figure 1:
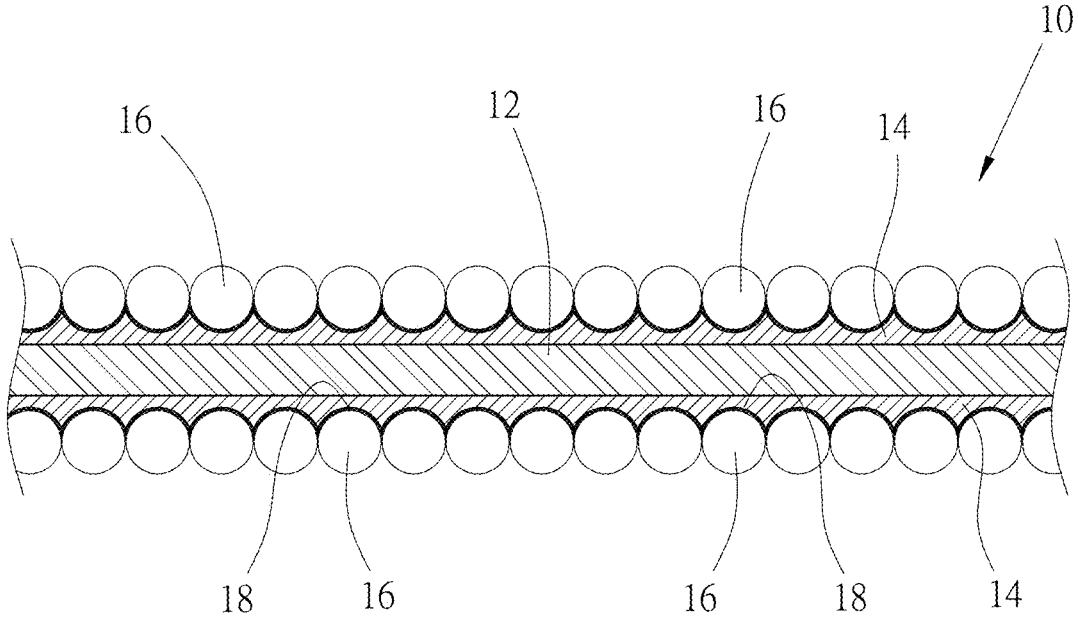
FIG. 1 is a longitudinal-sectional view of a conventional light-reflective film.
Figure 2:
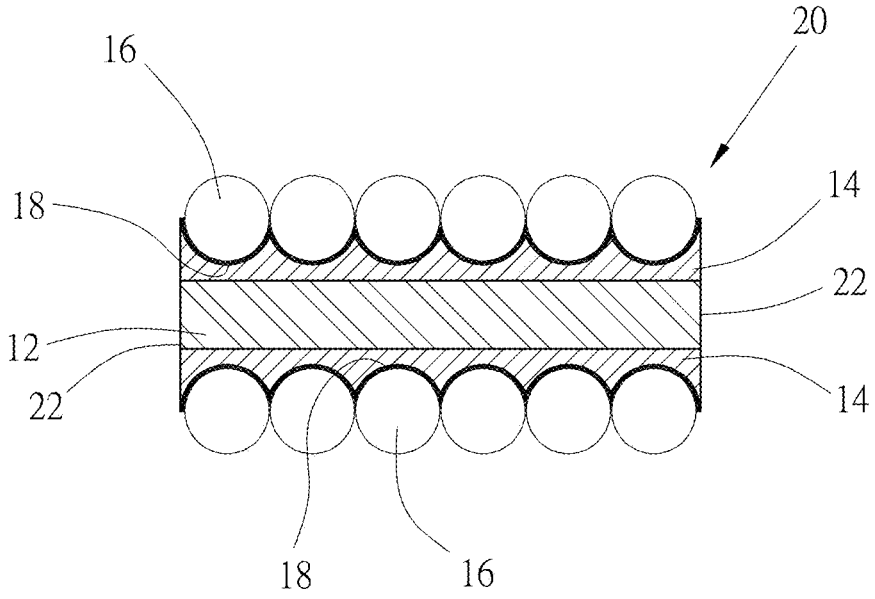
FIG. 2 is a cross-sectional view of a conventional light-reflective yarn formed by cutting from the light-reflective film in FIG. 1.
Figure 3:
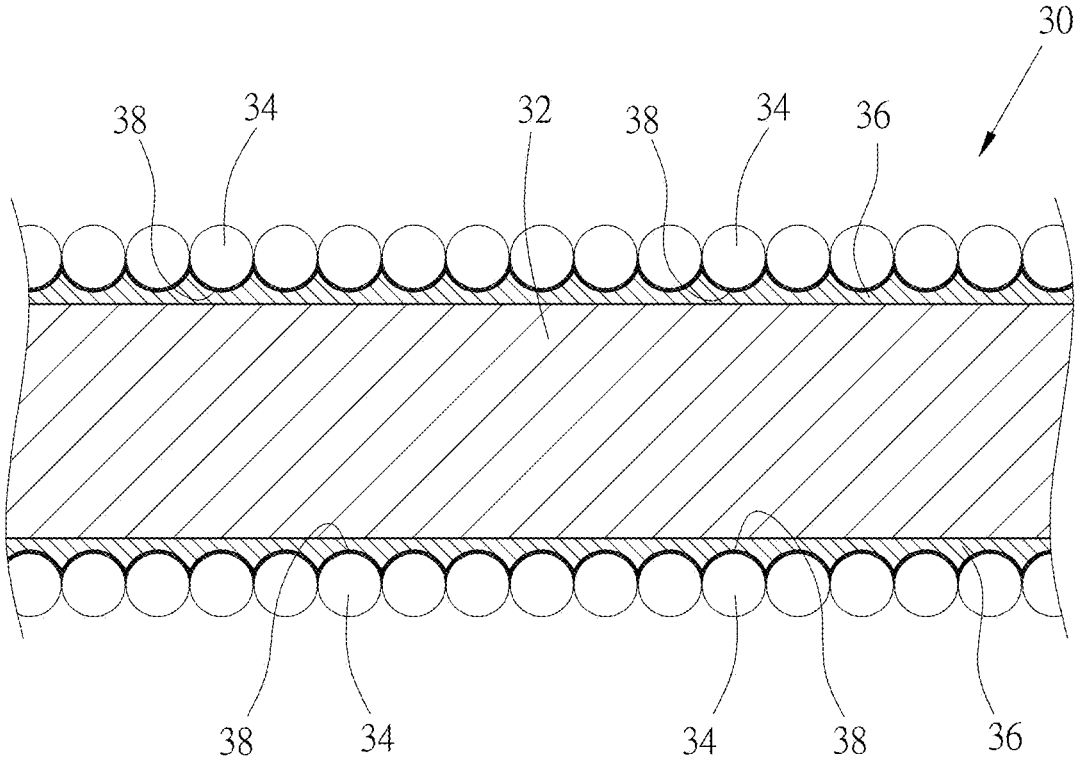
FIG. 3 is a longitudinal-sectional view of a light-reflective film disclosed in a preferred embodiment of the invention.

Please refer to FIG. 3 for a light-reflective film 30, which has a base layer 32 and two layers of glass microbeads 34. The base layer 32 has two opposite surfaces; the glass microbeads 34 are respectively adhered to the two surfaces of the base layer 32 via adhesive layers 36. Two reflective layers 38 are provided below the two layers of glass microbeads 34. A thickness of the light-reflective film 30 in this preferred embodiment is about 0.1 mm to 0.4 mm, preferably 0.25 mm to 0.35 mm.

The base layer 32 can be an elastic or inelastic high molecular polymer. If the base layer 32 is an elastic polymer, it can be, but is not limited to, thermoplastic polyurethane (TPU), polyurethane (PU), thermoplastic elastomer (TPE), thermoplastic rubber (TPR) or silicone; if the base layer 32 is an inelastic polymer, it can be, but is not limited to, polyester, polyethylene terephthalate (PET), rigid polyvinyl chloride (PVC), oriented polypropylene (OPP) or nylon. The base layer 32 can also be made of cloth instead of polymer.

The reflective layer 38 is provided on bottom sides (inner surfaces) of the layered glass microbeads 34. The bottom sides (inner sides) of the glass microbeads 34 are partially embedded in the adhesive layer 36, and are adhered to the base layer 32 by the adhesive layer 36. Top sides (outer sides) of the glass microbeads 34 are exposed on the adhesive layer 36.

The adhesive layer 36 is made of resin material, and any resin that can be used as an adhesive can be used as a material of the adhesive layer 36. Preferably, but not limited to, the adhesive layer 36 is a polyurethane adhesive or an acrylic acid adhesive.

The reflective layer 38 is preferably made of a light-reflective metal material such as aluminum or silver, but is not limited thereto. The reflective layer 38 is evaporated, sputtered or chemically coated on the bottom sides of the glass microbeads 34. The reflective layer 38 made of aluminum or silver has a high light reflectivity, and the light-reflective yarn produced provides reflected light with a high lumen value. In addition, the reflective layer 38 can also be made of other materials, such as zinc sulfide, the light-reflective yarn with the reflective layer 38 made of zinc sulfide is capable of providing reflected light with a medium lumen value, such as 100 to 200 lumens.

Figure 4:
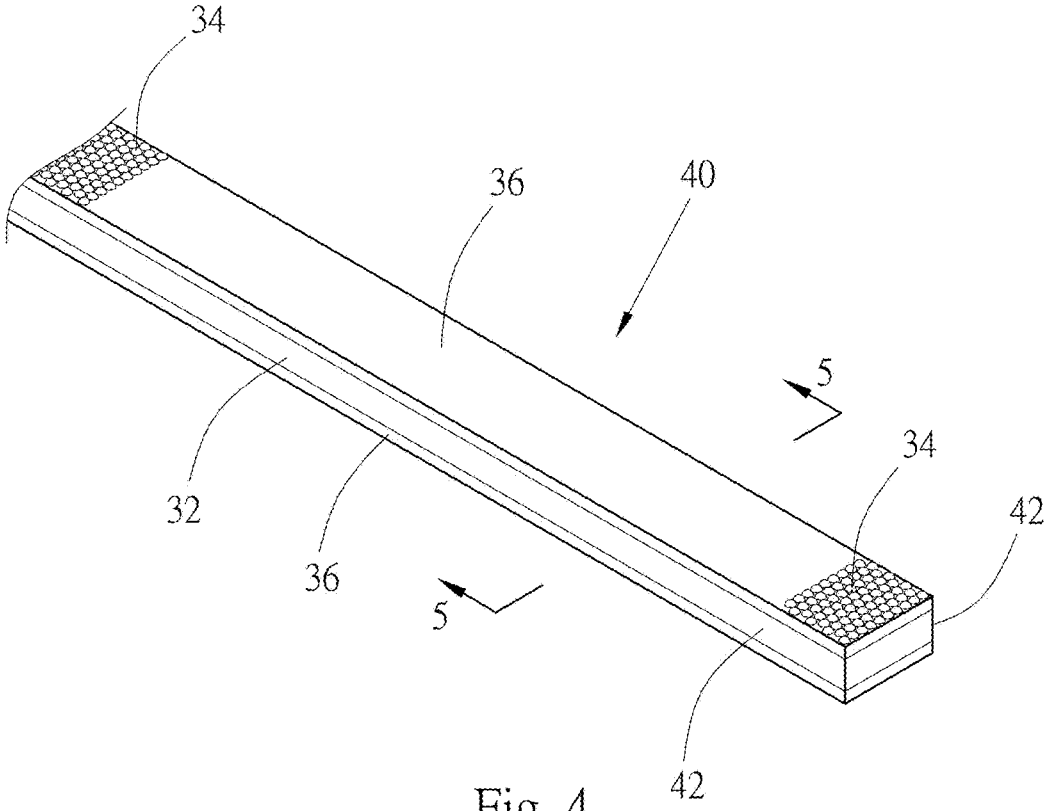
FIG. 4 is a perspective view of a light-reflective yarn of a preferred embodiment of the invention, the light-reflective yarn is made by cutting from the light-reflective film in FIG. 3.
Figure 5:
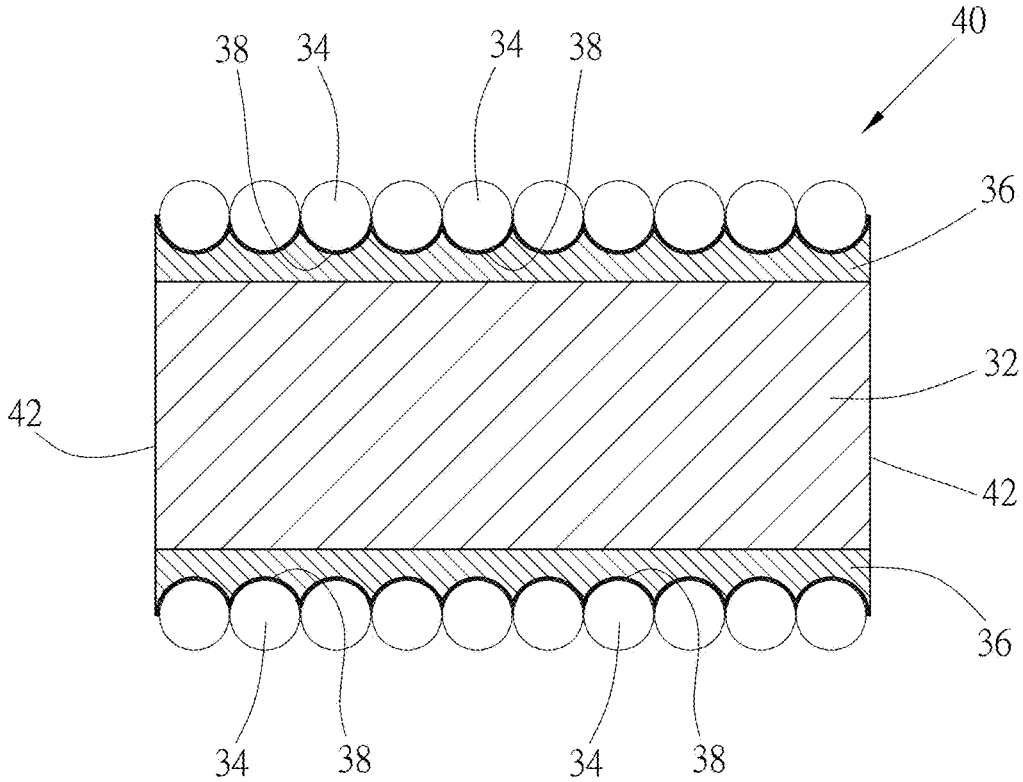
FIG. 5 is a cross-sectional view along section line 5-5 in FIG. 4.

The light-reflective film 30 is cut with a cutting tool along a length direction to produce a plurality of light-reflective yarns 40, and the light-reflective yarns 40 have a considerable length. FIGS. 4 and 5 show schematic diagrams of the cut light-reflective yarn 40, which is a layered material formed by stacking the base layer 32, the glass microbeads 34, the adhesive layers 36 and the reflective layers 38, and has two opposite surfaces (for example, top and bottom surfaces shown in FIGS. 4 and 5) and sides other than the two surfaces. The glass microbeads 34 are exposed on the two surfaces of the light-reflective yarn 40. Based on directions of FIG. 5, the two sides (the two surfaces on the two sides) 42 of the light-reflective yarn 40 are cut surfaces, and the glass microbeads 34 are not provided on the sides 42. The light is retroreflected by the glass microbeads 34 and the reflective layer 38, the light-reflective yarn 40 is a light-reflective yarn with a high light-reflective lumen value. A width of the light-reflective yarn 40 is between 0.15 mm and 1 mm, preferably between 0.28 mm and 0.50 mm, more preferably between 0.30 mm and 0.38 mm; a thickness thereof is a thickness of the light-reflective film 30.

Figure 6:
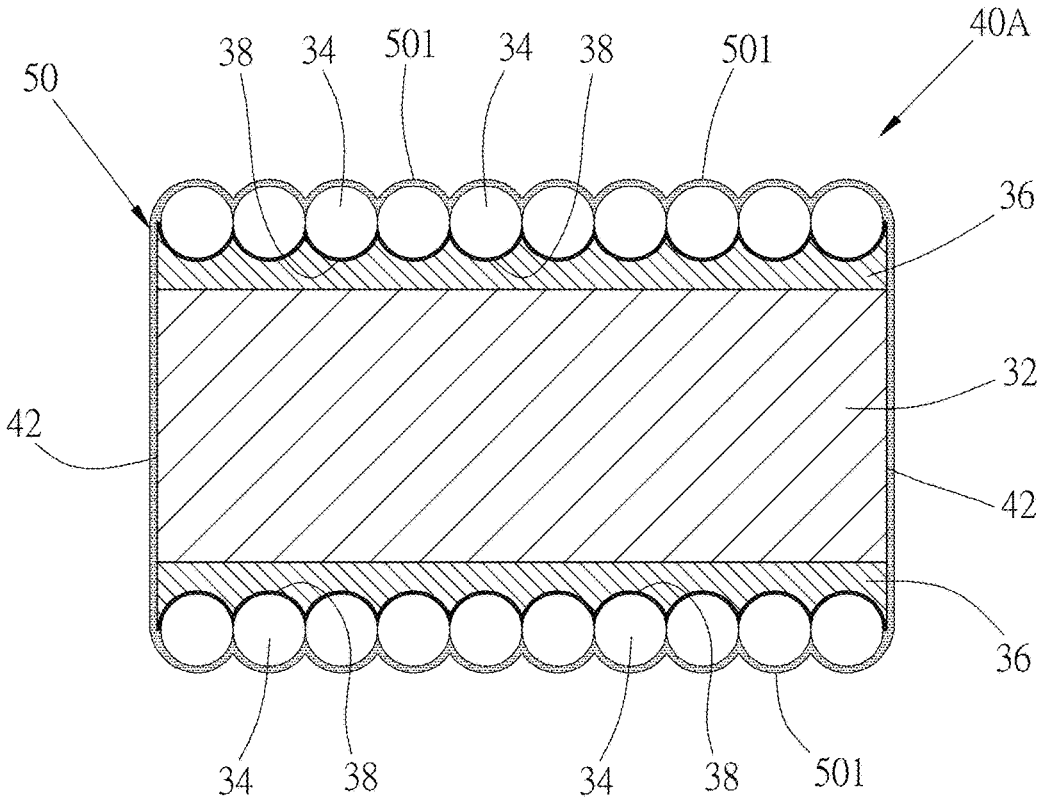
FIG. 6 is a cross-sectional view of a finished product of the light-reflective yarn with a wrapping layer of a first preferred embodiment of the invention.

Please refer to FIG. 6, in order to prevent the exposed glass microbeads 34 of the light-reflective yarn 40 in FIG. 5 from detaching or falling off, the invention wraps the entire light-reflective yarn 40 in FIG. 5 with a wrapping layer 50 made of a resin material to form a light-reflective yarn 40A wrapped by the wrapping layer 50 as shown in FIG. 6. The wrapping layer 50 has transmittancy and light can pass through the wrapping layer 50. In implementation, the wrapping layer 50 can be transparent and colorless, or can have color. Through a color of the wrapping layer 50, the light-reflective yarn 40A becomes a colored light-reflective yarn.

Figure 7:
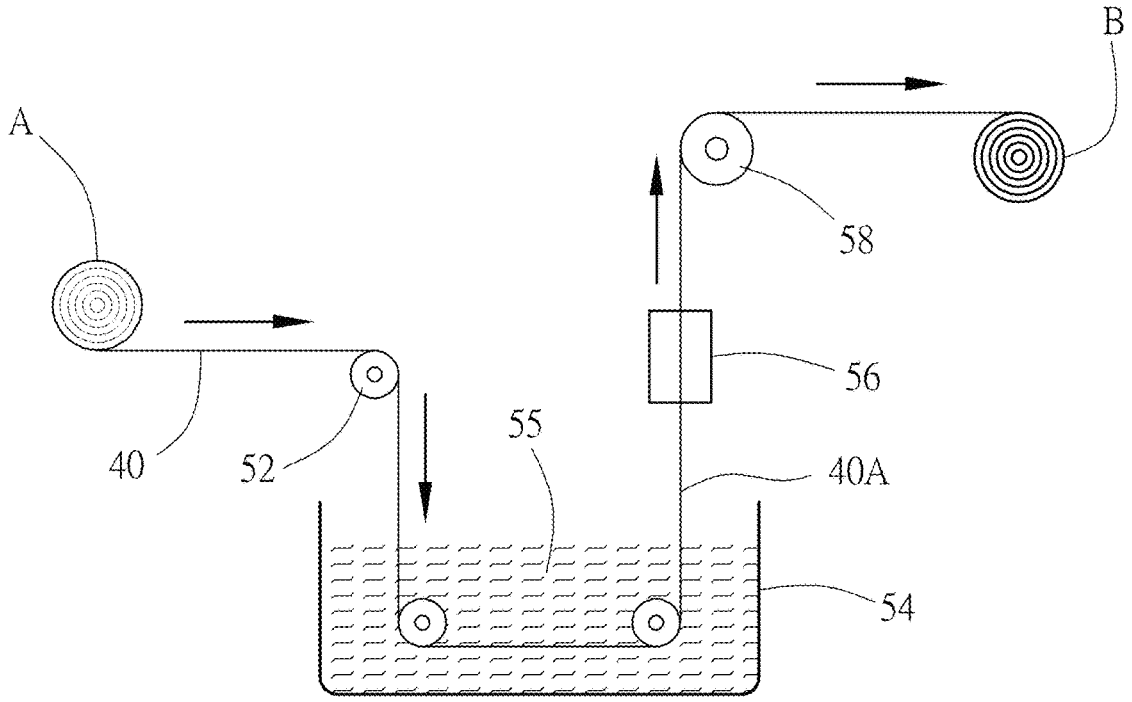
FIG. 7 is a schematic diagram of a manufacturing process of wrapping the light-reflective yarn with the wrapping layer in FIG. 6.

FIG. 7 is a schematic diagram of a manufacturing process showing a preferred embodiment of the invention in which the wrapping layer 50 is provided on an outer surface of the light-reflective yarn 40. As shown in the figure, each of light-reflective yarns 40 made by cutting is released from a roll A, and is introduced into a solution tank 54 through a roller 52. The solution tank 54 is filled with a resin solution 55, the light-reflective yarn 40 is immersed in the resin solution 55 to cause the entire outer surface of the light-reflective yarn 40 being wrapped with liquid resin, and then the resin-wrapped light-reflective yarn 40A is moved out of the solution tank 54. A drying device is used to dry the resin that wraps the light-reflective yarn 40A in order to form the wrapping layer 50, and then the produced light-reflective yarn 40A is rolled up for use, for example, rolled into a roll B. The drying device can be a single drying unit or have a plurality of drying units as shown in FIG. 7. A first drying unit 56 shown in FIG. 7 can be a blower with a hot temperature, a hot roller, or various drying device with a heating pipe; a second drying unit 58 can be a hot roller or a blower. One hot roller or a plurality of continuous hot rollers can also be used as a drying device to dry the resin that wraps the light-reflective yarn 40A.

The wrapping layer 50 wraps the light-reflective yarn 40 along the surface of the light-reflective yarn 40. The wrapping layer 50 covers each glass microbead 34 with an arc-shaped coating portion 501 on the outer surface of each glass microbead 34, as shown in FIG. 6.

In this preferred embodiment, components of the resin of the resin solution 55 include silane and a color material, such as a pigment. The pigment is a dye or a colorant with extremely high transparency. The pigment with extremely high transparency has a low light shielding rate, will not prevent light from penetrating the wrapping layer 50. The silane can be an oil-based silane or a water-based silane; the transparent pigment is an extremely transparent ink, which can be a water-based ink or an oil-based ink. According to the light-reflective yarn 40 made by the applicant, a lumen value of reflected light of a bare yarn is 600 lumens, while light-reflective lumens of the light-reflective yarn 40A with the wrapping layer 50 are still as high as 400 lumens.

The resin of the wrapping layer 50 can be a resin containing acrylic acid and silane, or a resin containing thermoplastic polyurethane and silane, or a resin mixed with acrylic acid, silane and thermoplastic polyurethane. The silane in the resin has good bonding properties and adhesive properties with the adhesive layer 36 and the glass microbeads 34 of the light-reflective yarn 40. The silane is suitable for both acrylic acid series and polyurethane series resins, regardless of whether the adhesive layer 36 is acrylic acid or polyurethane series adhesive, the wrapping layer 50 can be well bonded with the adhesive layer 36. Meanwhile, the silane can grasp and hold the glass microbeads 34, that is, the silane has good bonding properties with the glass microbeads 34, making it difficult for the glass microbeads 34 and the silane to separate.

One component of the resin solution 55 in a preferred embodiment of the invention comprises: pigment (such as transparent ink), additive (i.e., silane), bridging agent (curing agent), TPU resin, and organic solvent (VOC). Another component of the resin solution 55 in the preferred embodiment of the invention comprises: pigment, additive (i.e., silane), bridging agent, acrylic acid resin, and organic solvent.

Figure 8:
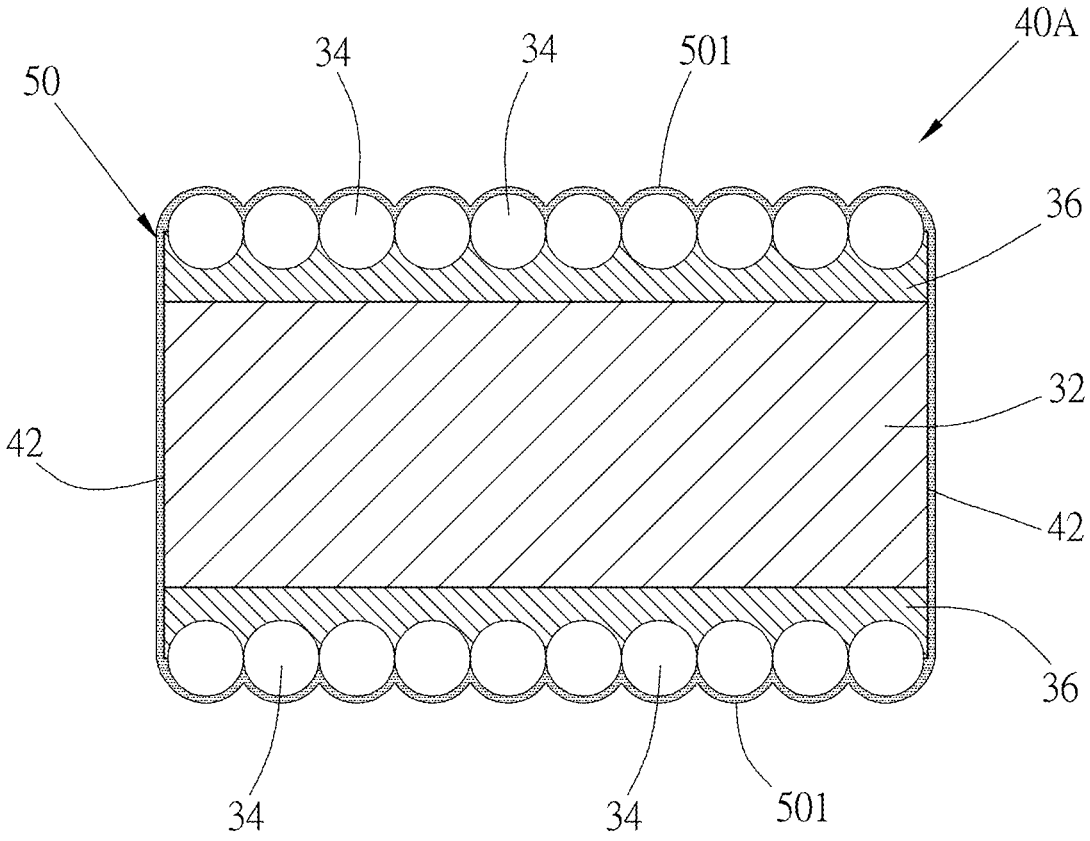
FIG. 8 is a cross-sectional view of the light-reflective yarn with the wrapping layer of a second preferred embodiment of the invention.

FIG. 8 is a cross-sectional view of the light-reflective yarn 40A of a second preferred embodiment of the invention, structures thereof are basically the same as those of the light-reflective yarn 40A of FIG. 6, which has: the base layer 32, the glass microbeads 34, the two adhesive layers 36 and the wrapping layer 50, two layers of the glass microbeads 34 are respectively adhered to the two opposite surfaces of the base layer 32 through the two adhesive layers 36, and the wrapping layer 50 wraps the entire light-reflective yarn 40A. On the outer surface of each glass microbead 34, the wrapping layer 50 covers each glass microbead 34 with an arc-shaped coating portion 501.

The light-reflective yarn 40A in FIG. 8 is not provided with a reflective layer, so a lumen value of reflected light is low.

Figure 9:
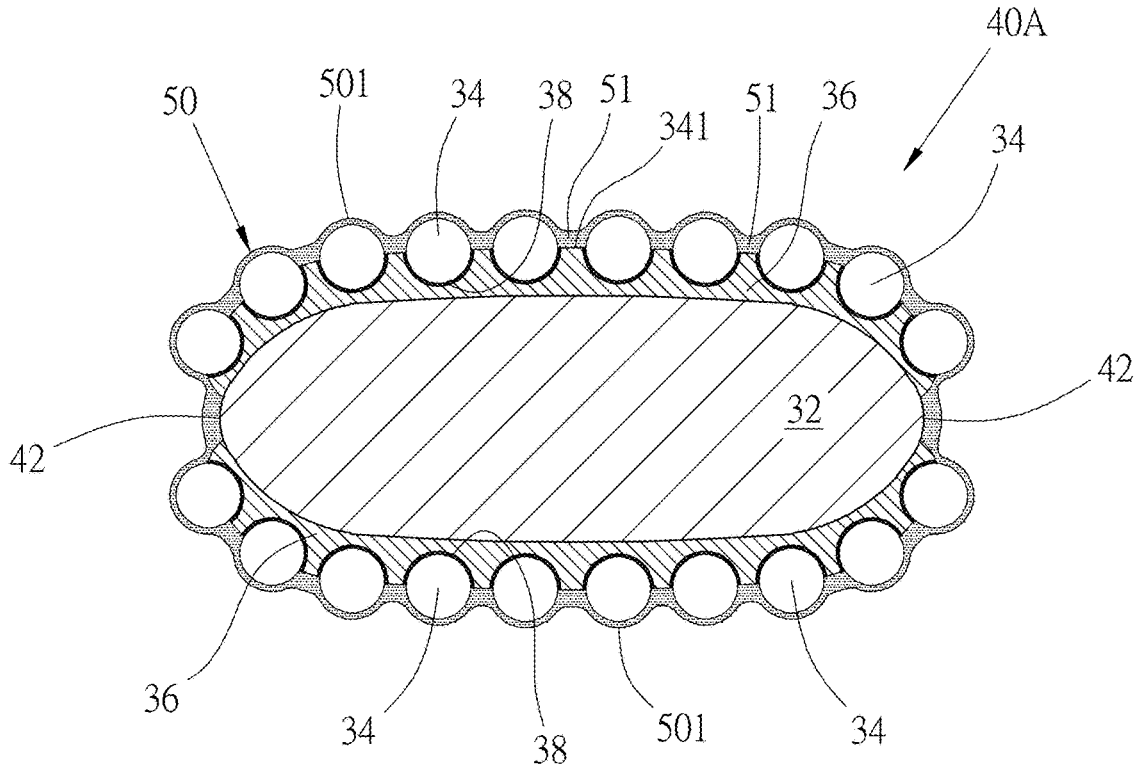
FIG. 9 is a cross-sectional view of the light-reflective yarn with the wrapping layer of a third preferred embodiment of the invention.

FIG. 9 shows the light-reflective yarn 40A according to a third preferred embodiment of the invention, which has the base layer 32, the two layers of glass microbeads 34, the two adhesive layers 36, the two reflective layers 38 and the wrapping layer 50. A cross-sectional shape of the light-reflective yarn 40A is generally an elliptical shape, which is formed by stretching the light-reflective yarn 40 in FIG. 5. The stretched light-reflective yarn 40A has better physical properties. The two adhesive layers 36 form a larger specific surface area, enabling the glass microbeads 34 to be distributed over a larger proportion of an area, while an area of the two sides 42 of the light-reflective yarn 40A is reduced. In this preferred embodiment, the light-reflective yarn 40 is first stretched, and then operation of wrapping with the wrapping layer 50 in FIG. 7 is performed to produce the light-reflective yarn 40A. The reflective layer 38 can be aluminum, silver or zinc sulfide. In this preferred embodiment, there is a gap 341 between the two adjacent glass microbeads 34. The wrapping layer 50 has a color, and the wrapping layer 50 has a larger thickness 51 (greater than a thickness of the wrapping layer 50 on the surfaces of the glass microbeads 34) at each of the gaps 341, so that thicker and more ink is accumulated at the gaps 341, making a color purity of the light-reflective yarn 40A higher and a hue more obvious. On the outer surface of each glass microbead 34, the wrapping layer 50 covers each glass microbead 34 with an arc-shaped coating portion 501.

Figure 10:
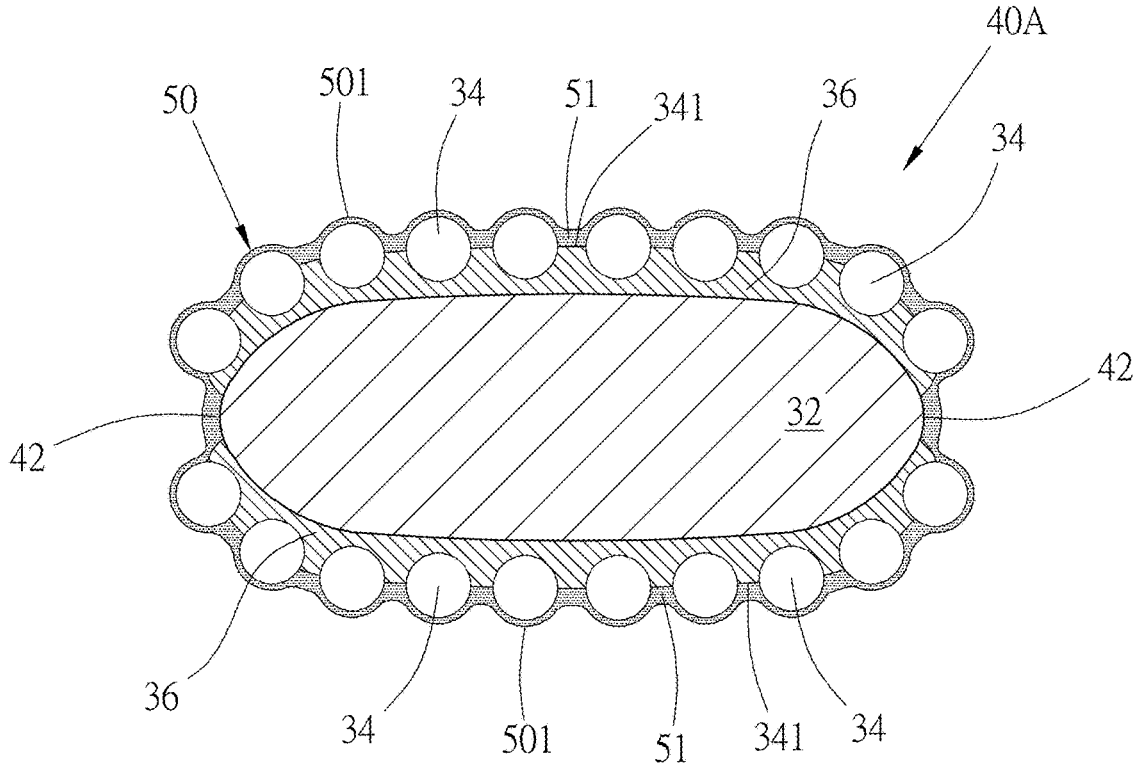
FIG. 10 is a cross-sectional view of the light-reflective yarn with the wrapping layer of a fourth preferred embodiment of the invention.

FIG. 10 shows the light-reflective yarn 40A according to a fourth preferred embodiment of the invention, structures and components thereof are the same as those of the light-reflective yarn 40A in FIG. 9, which has the base layer 32, the two layers of glass microbeads 34, the adhesive layer 36 and the wrapping layer 50. An only difference is that the light-reflective yarn 40A in FIG. 10 is not provided with a reflective layer. The wrapping layer 50 covers the entire light-reflective yarn 40A. Similarly, the wrapping layer 50 forms the larger thickness 51 with more ink at the gap 341 between the two adjacent glass microbeads 34, so that ink accumulation at the gaps 341 is thicker and the ink is more, making a color of the light-reflective yarn 40A purer and bright. The wrapping layer 50 covers each of the glass microbeads 34 with an arc-shaped coating portion 501 on the outer surface of each of the glass microbeads 34.

As shown in FIGS. 6, 8 to 10, the wrapping layer 50 of the light-reflective yarn 40A made by the invention covers the entire light-reflective yarn 40A, and the glass microbeads 34 are wrapped in the wrapping layer 50. The wrapping layer 50 protects the glass microbeads 34, preventing the glass microbeads 34 of the light-reflective yarn 40A from falling off, and good adhesive properties and bonding properties between the resin of the wrapping layer 50 and the glass microbeads 34 are capable of maintaining positioning of the glass microbeads 34. Therefore, the light-reflective yarn 40A can be knitted by various knitting machines. Even if the light-reflective yarn 40A is pulled by a crochet needle of a circular knitting machine or a warp knitting computer jacquard machine, the glass microbeads 34 will not fall or detach, so it can effectively solve the problem of glass microbeads falling into a knitting machine and causing damage to the knitting machine, and also solves the problem of loss of light-reflective efficiency in conventional light-reflective yarns. The wrapping layer 50 with resin component is capable of wrapping the light-reflective yarn 40A and does not dissolve, separate from the light-reflective yarn 40A, and does not produce stickiness. The wrapping layer 50 of the invention covers each glass microbead 34 with an arc-shaped coating portion 501 on the outer surface of each glass microbead 34.

Figure 11:
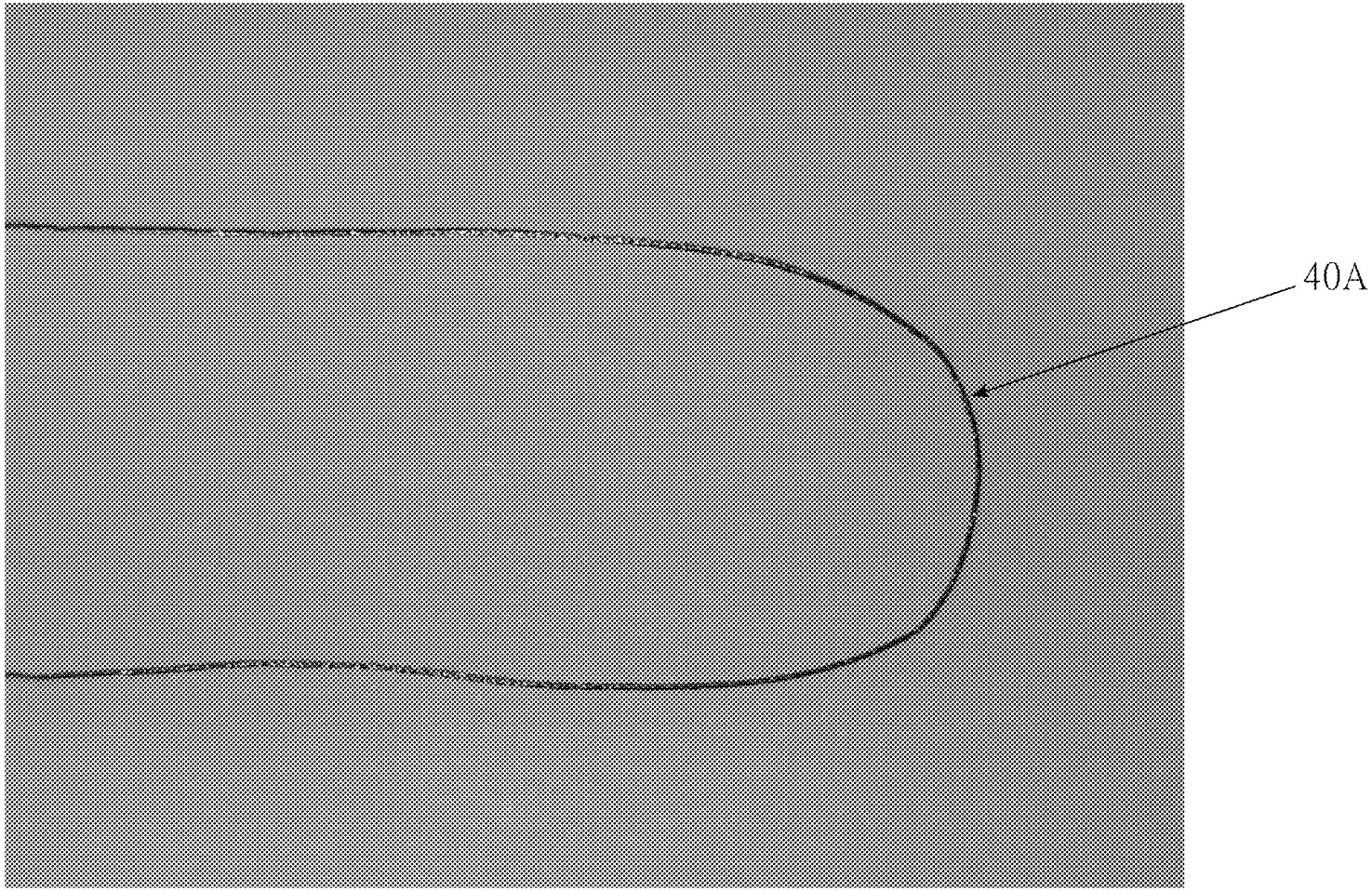
FIG. 11 is a photo of a finished product of the light-reflective yarn of a preferred embodiment of the invention.

The light-reflective yarn 40A of the invention is capable of solving the problems of revealing silver in color from sides of conventional high-lumen light-reflective yarns and different colors at different positions of the conventional light-reflective yarns. In the preferred embodiments of the light-reflective yarn 40A in FIGS. 6 and 9, the wrapping layer 50 is made transparent red. The wrapping layer 50 covers the entire light-reflective yarn 40A, so the two surfaces (top surface, bottom surface) and the two sides 42 of the light-reflective yarn 40A are all red, the color is the same at each position, and there is no revealing silver on the sides 42 of the light-reflective yarn 40A. FIG. 11 is a photo (presented in black and white in this specification) of the light-reflective yarn 40A in FIG. 9. It can be proved from FIG. 11 that the top surface, the bottom surface and the sides 42 of the light-reflective yarn 40A have the same color.

If the light-reflective yarn 40A does not need to be colored, the resin solution 55 used to form the wrapping layer 50 does not need to add pigments. If the light-reflective yarn 40A of the invention needs to have a color, production of the colored light-reflective film 30 is not required, that is, the light-reflective film 30 does not need to make a color layer, instead the wrapping layer 50 is made to have a color. The colored wrapping layer 50 wraps the light-reflective yarn 40A to produce the colored light-reflective yarn 40A. Therefore, regardless of whether the light-reflective yarn 40A needs to be made with a color, it is not required to produce the light-reflective film 30 with a color, which makes production of the light-reflective film 30 simpler and reduces inventory costs of the light-reflective film 30.

With the structures of the light-reflective yarn 40A of the invention, it is not required to make the light-reflective film 30 with a color in order to make the colored light-reflective yarn 40A. Therefore, the colored light-reflective yarn 40A can also be produced with a small order amount, solving the problem that the industry cannot produce a small amount of the colored light-reflective film 30.

A light-reflective lumen value of the light-reflective yarn 40A in FIGS. 6 and 9 can reach more than 300 lumens. The invention is capable of providing the light-reflective yarn 40A with a high light-reflective lumen value. The higher a light-reflective efficiency, the better the safety and protection effects can be achieved.

Figure 12:
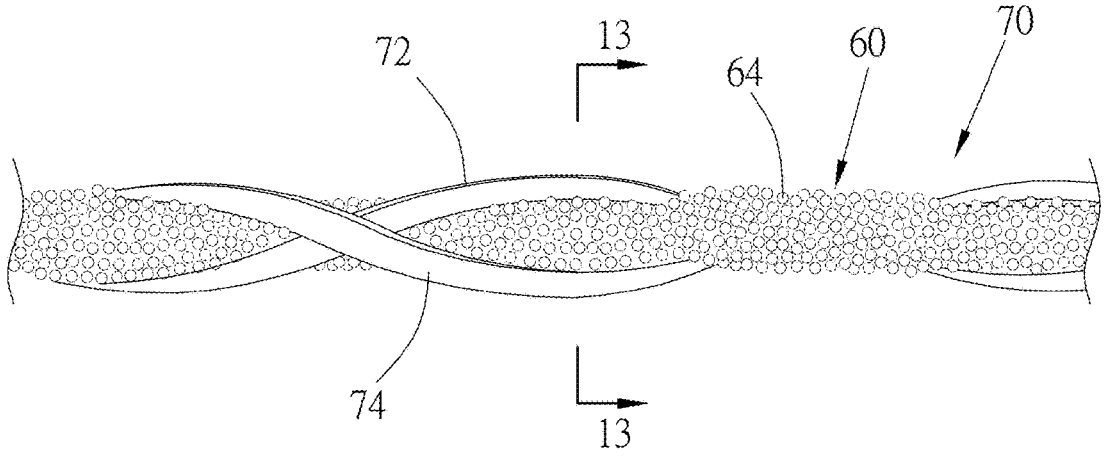
FIG. 12 is a schematic diagram of a reflective composite yarn, comprising the reflective yarn of the invention and two wrapping yarns.
Figure 13:
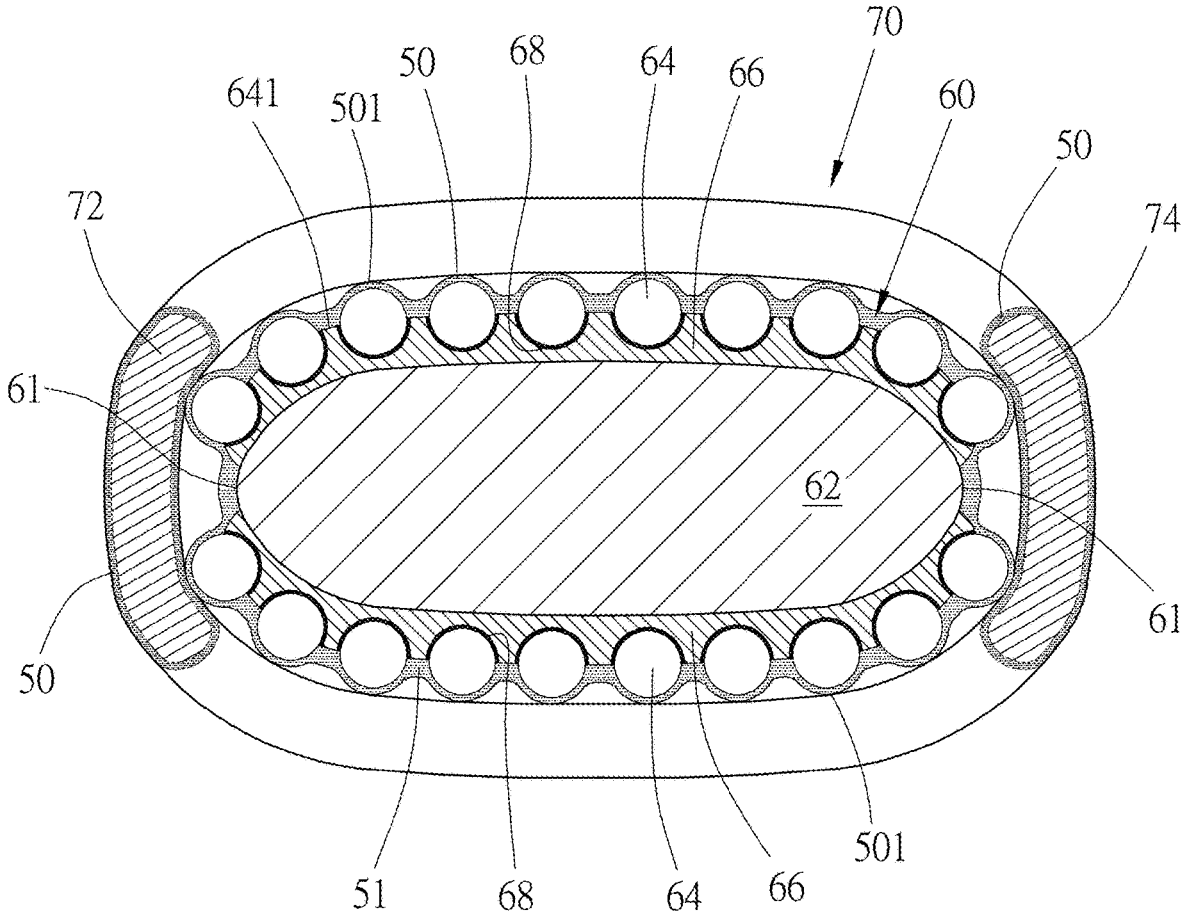
FIG. 13 is a cross-sectional view taken along line 13-13 of FIG. 12.

FIGS. 12 and 13 show a reflective yarn 60 of a fifth preferred embodiment of the invention, which may be an unstretched reflective yarn as shown in FIGS. 6 and 8, or a stretched reflective yarn as shown in FIGS. 9 and 10. The reflective yarn 60 has a base layer 62, two layers of glass microbeads 64, two adhesive layers 66, and may have two reflective layers 68, and gaps 641 between the glass microbeads 64. An outer periphery of the reflective yarn 60 is wrapped with at least one wrapping yarn to form a reflective composite yarn 70. For example, a wrapping yarn is wrapped around the periphery of the reflective yarn in an S direction or a Z direction, and the wrapping yarn may be a monofilament yarn or a multifilament yarn. The reflective yarn 60 forms a core yarn of the reflective composite yarn 70.

In this preferred embodiment, the outer periphery of the reflective yarn 60 is wrapped with two wrapping yarns 72, 74 in the S direction and the Z direction respectively, so that the strength of the reflective yarn 60 can be strengthened by the two wrapping yarns 72, 74. Preferably, the two wrapping yarns 72, 74 wrap the reflective yarn 60 in a manner that more or the most glass microbeads are exposed as possible, so that the reflective effect is not impaired or is not impaired too much, as shown in FIG. 12, on the outer surface of the reflective yarn 60, the area of the glass microbeads exposed is larger than the wrapping area of the two wrapping yarns 72, 74, and the reflective yarn 60 still has a good reflective effect.

The reflective composite yarn 70, through the process of FIG. 7, is provided with a wrapping layer 50 on its outer periphery, as shown in FIG. 13, the outer surface of the reflective yarn 60 and the outer surfaces of the two wrapping yarns 72, 74 are wrapped by the wrapping layer 50. The wrapping layer 50 covers the entire reflective yarn 60, prevents the glass microbeads 64 of the reflective yarn 60 from falling off, and makes the two surfaces of the reflective yarn 60 (the top surface, the bottom surface) and the two side edges 61 all of the same color, which can solve the problem of silver leakage (showing silver color) on the side surfaces of the commonly known high lumen reflective yarns, and the color of different locations of the reflective yarns is not the same. The two side edges 61 are of the same color, which can solve the problems of silver leakage (showing silver) on the side faces of the conventional high-lumen reflective yarns, and the color of the reflective yarns is not the same at different positions.

Figure 14:
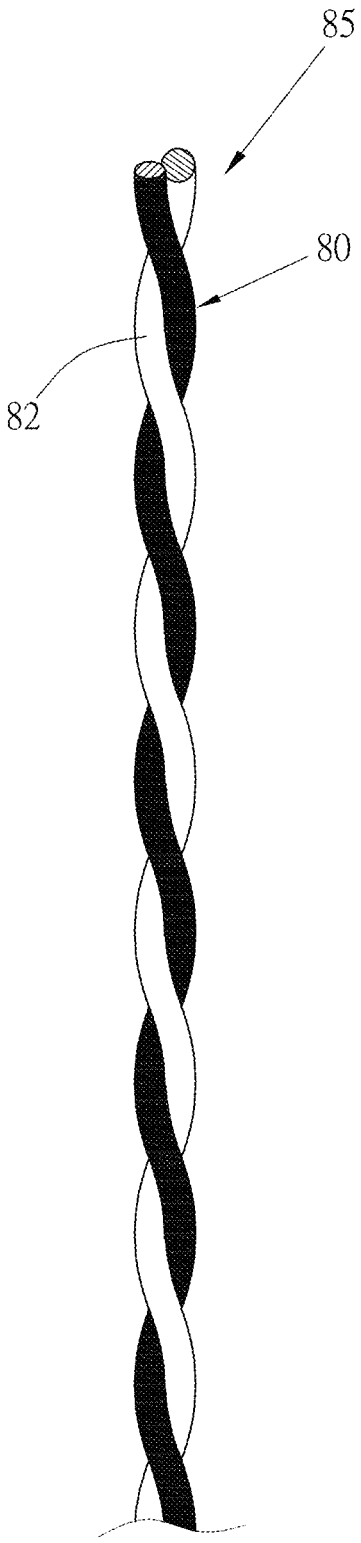
FIG. 14 is a schematic diagram of a reflective yarn of the invention and a yarn forming a twisted yarn.

FIG. 14 shows a reflective yarn 80 of a sixth preferred embodiment of the invention, which may be an unstretched reflective yarn as shown in FIG. 6 or FIG. 8, or a stretched reflective yarn as shown in FIG. 9 or FIG. 10. The reflective yarn 80 is twisted with one yarn 82 or a plurality of yarns to form a twisted yarn 85, which serves as a core yarn of a reflective composite yarn, and one or more yarns, such as the wrapping yarns 72, 74 of FIG. 12, are wrapped around the periphery of the twisted yarn 85 to form a reflective composite yarn. The reflective composite yarn is provided with a wrapping layer on the outer periphery so that the twisted yarn 85 and the outer periphery of the wrapping yarns are covered by the wrapping layer.

The light-reflective yarn provided by the invention is capable of solving various problems in manufacturing and weaving of conventional light-reflective yarns.

Although the invention has been disclosed as above with the embodiments, it is not intended to limit the invention. A person having ordinary skill in the art to which the invention pertains can make various changes and modifications without departing from the spirit and scope of the invention. Therefore, scope of protection of the invention shall be subject to what is defined in the pending claims.

What is claimed is:

1. A light-reflective yarn capable of preventing glass microbeads from falling off, comprising:

a base layer having two opposite surfaces;

a plurality of glass microbeads, the glass microbeads adhering to at least one of the surfaces of the base layer with at least one adhesive layer and forming at least one layer of glass microbeads;

the light-reflective yarn being formed by stacking the base layer, the glass microbeads and the adhesive layer, and having two surfaces and sides other than the two surfaces; the at least one layer of the glass microbeads being disposed on at least one of the surfaces of the light-reflective yarn; and a wrapping layer made of a resin material and having transmittancy, the wrapping layer wrapping the light-reflective yarn, including covering the glass microbeads and wrapping the sides of the light-reflective yarn;

wherein the wrapping layer is a resin containing acrylic acid and silane, or a resin containing thermoplastic polyurethane and silane, or a resin containing acrylic acid, silane and thermoplastic polyurethane.

2. The light-reflective yarn as claimed in claim 1, wherein the wrapping layer covers each of the glass microbeads with an arc-shaped coating portion on an outer surface of each of the glass microbeads.

3. The light-reflective yarn as claimed in claim 1, wherein the resin of the wrapping layer has a color.

4. The light-reflective yarn as claimed in claim 3, wherein a transparent pigment is added to the resin of the wrapping layer.

5. The light-reflective yarn as claimed in claim 4, wherein the transparent pigment is a transparent ink.

6. The light-reflective yarn as claimed in claim 3, wherein the sides of the light-reflective yarn have the color of the wrapping layer.

7. The light-reflective yarn as claimed in claim 1, wherein the wrapping layer is formed by heat drying a liquid resin.

8. The light-reflective yarn as claimed in claim 1, wherein the adhesive layer is a material containing acrylic acid or a material containing polyurethane.

9. The light-reflective yarn as claimed in claim 1, wherein a gap is provided between adjacent glass microbeads; the wrapping layer forms a larger thickness at each of the gaps.

10. The light-reflective yarn as claimed in claim 9, wherein the wrapping layer has a color, a pigment, or a color material that forms the color of the wrapping layer is in a greater amount at the gaps.

11. The light-reflective yarn as claimed in claim 1, comprising:

at least one wrapping yarn wrapped around an outer periphery of the light-reflective yarn to form a reflective composite yarn, the light-reflective yarn constituting a core yarn of the reflective composite yarn, the outer periphery of the light-reflective yarn and the at least one wrapping yarn are covered by the wrapping layer.

12. The light-reflective yarn as claimed in claim 11, wherein the light-reflective yarn and the at least one wrapping yarn form a twisted yarn, the twisted yarn constitutes the core yarn of the reflective composite yarn, and the outer periphery of the twisted yarn is covered by the wrapping layer.

13. A light-reflective yarn capable of preventing glass microbeads from falling off, comprising:

a base layer having two opposite surfaces;

a plurality of glass microbeads, the glass microbeads adhering to at least one of the surfaces of the base layer with at least one adhesive layer and forming at least one layer of glass microbeads;

at least one reflective layer disposed on bottom sides of the glass microbeads;

the light-reflective yarn being formed by stacking the base layer, the glass microbeads, the adhesive layer and the reflective layer, and having two surfaces and sides other than the two surfaces; the at least one layer of the glass microbeads and the at least one reflective layer being disposed on at least one of the surfaces of the light-reflective yarn; and a wrapping layer made of a resin material and having transmittancy, the wrapping layer wrapping the light-reflective yarn, including covering the glass microbeads and wrapping the sides of the light-reflective yarn;

wherein the wrapping layer is a resin containing acrylic acid and silane, or a resin containing thermoplastic polyurethane and silane, or a resin containing acrylic acid, silane and thermoplastic polyurethane.

14. The light-reflective yarn as claimed in claim 13, wherein the wrapping layer covers each of the glass microbeads with an arc-shaped coating portion on an outer surface of each of the glass microbeads.

15. The light-reflective yarn as claimed in claim 13, wherein the resin of the wrapping layer has a color.

16. The light-reflective yarn as claimed in claim 15, wherein a transparent pigment is added to the resin of the wrapping layer.

17. The light-reflective yarn as claimed in claim 16, wherein the transparent pigment is a transparent ink.

18. The light-reflective yarn as claimed in claim 15, wherein the sides of the light-reflective yarn have the color of the wrapping layer.

19. The light-reflective yarn as claimed in claim 13, wherein the wrapping layer is formed by heat drying a liquid resin.

20. The light-reflective yarn as claimed in claim 13, wherein the adhesive layer is a material containing acrylic acid or a material containing polyurethane.

21. The light-reflective yarn as claimed in claim 13, wherein a gap is provided between adjacent glass microbeads; the wrapping layer forms a larger thickness at each of the gaps.

22. The light-reflective yarn as claimed in claim 21, wherein the wrapping layer has a color, a pigment, or a color material that forms the color of the wrapping layer is in a greater amount at the gaps.

23. The light-reflective yarn as claimed in claim 13, comprising: at least one wrapping yarn wrapped around an outer periphery of the light-reflective yarn to form a reflective composite yarn, the light-reflective yarn constituting a core yarn of the reflective composite yarn, the outer periphery of the light-reflective yarn and the at least one wrapping yarn are covered by the wrapping layer.

24. The light-reflective yarn as claimed in claim 23, wherein the light-reflective yarn and the at least one wrapping yarn form a twisted yarn, the twisted yarn constitutes the core yarn of the reflective composite yarn, and the outer periphery of the twisted yarn is covered by the wrapping layer.

* * * * *